US010635010B2

(12) United States Patent
Kamikura et al.

(10) Patent No.: US 10,635,010 B2
(45) Date of Patent: Apr. 28, 2020

(54) TONER

(71) Applicant: CANON KABUSHIKI KAISHA, Tokyo (JP)

(72) Inventors: Kenta Kamikura, Yokohama (JP); Kunihiko Nakamura, Gotemba (JP); Maho Tanaka, Tokyo (JP); Yusuke Kosaki, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/253,999

(22) Filed: Jan. 22, 2019

(65) Prior Publication Data

US 2019/0235404 A1 Aug. 1, 2019

(30) Foreign Application Priority Data

Jan. 26, 2018 (JP) ..... 2018-011287

(51) Int. Cl.

| | |
|---|---|
| ***G03G 9/093*** | (2006.01) |
| ***G03G 9/08*** | (2006.01) |
| ***G03G 9/097*** | (2006.01) |
| ***G03G 9/087*** | (2006.01) |
| *G03G 9/09* | (2006.01) |

(52) U.S. Cl.

CPC ..... *G03G 9/0825* (2013.01); *G03G 9/0806* (2013.01); *G03G 9/0819* (2013.01); *G03G 9/08755* (2013.01); *G03G 9/09328* (2013.01); *G03G 9/09342* (2013.01); *G03G 9/09775* (2013.01); *G03G 9/09783* (2013.01); *G03G 9/09791* (2013.01); *G03G 9/0918* (2013.01)

(58) Field of Classification Search

None

See application file for complete search history.

(56) References Cited

U.S. PATENT DOCUMENTS 7,858,283 B2 12/2010 Ishigami et al.
7,927,775 B2 4/2011 Komatsu et al.

(Continued)

FOREIGN PATENT DOCUMENTS

JP 2004-325756 11/2004
JP 2011-102892 5/2011

OTHER PUBLICATIONS

U.S. Appl. No. 16/250,218, Kunihiko Nakamura, filed Jan. 17, 2019.

(Continued)

*Primary Examiner* — Janis L Dote

(74) *Attorney, Agent, or Firm* — Venable LLP

(57) ABSTRACT

A toner having a toner particle having a plurality of fine particles on the surface of a toner base particle, the toner base particle contains a binder resin, wherein a fine particle layer A constituted of a plurality of the fine particles is observed in an EDX mapping image of the constituent elements in a cross section of the toner particle as provided by EDX of the toner particle cross section observed using TEM; a fine particle B, containing a metal compound containing at least one metal element M selected from all the metal elements belonging to Groups 3 to 13, is observed in the fine particle layer A; and the number-average particle diameter D of the fine particle B, the average value H of the thickness of the fine particle layer A, and the standard deviation S on the thickness of the fine particle layer A satisfy prescribed relationships.

7 Claims, 2 Drawing Sheets

(56) References Cited

U.S. PATENT DOCUMENTS

| | | | |
|---|---|---|---|
| 7,939,233 | B2 | 5/2011 | Inoue et al. |
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,828,639 | B2 | 9/2014 | Kamikura et al. |
| 8,986,914 | B2 | 3/2015 | Fujikawa et al. |
| 9,034,549 | B2 | 5/2015 | Shiotari et al. |
| 9,256,148 | B2 | 2/2016 | Fujikawa et al. |
| 9,261,806 | B2 | 2/2016 | Moribe et al. |
| 9,285,697 | B2 | 3/2016 | Fukudome et al. |
| 9,309,349 | B2 | 4/2016 | Watanabe et al. |
| 9,423,708 | B2 | 8/2016 | Tominaga et al. |
| 9,429,860 | B2 | 8/2016 | Kinumatsu et al. |
| 9,594,323 | B2 | 3/2017 | Fujikawa et al. |
| 9,658,554 | B2 | 5/2017 | Kinumatsu et al. |
| 9,798,256 | B2 | 10/2017 | Kosaki et al. |
| 9,798,262 | B2 | 10/2017 | Toyoizumi et al. |
| 9,811,016 | B2 | 11/2017 | Aoki et al. |
| 9,823,595 | B2 | 11/2017 | Toyoizumi et al. |
| 9,829,820 | B2 | 11/2017 | Masumoto et al. |
| 9,857,713 | B2 | 1/2018 | Kosaki et al. |
| 9,869,943 | B2 | 1/2018 | Aoki et al. |
| 9,880,478 | B2 | 1/2018 | Shimano et al. |
| 9,897,933 | B2 | 2/2018 | Yoshida et al. |
| 9,921,501 | B2 | 3/2018 | Mochizuki et al. |
| 2009/0197190 | A1 | 8/2009 | Nakamura et al. |
| 2010/0028796 | A1 | 2/2010 | Nakamura et al. |
| 2010/0183971 | A1 | 7/2010 | Fujikawa et al. |
| 2018/0231901 | A1 | 8/2018 | Koji et al. |
| 2018/0246430 | A1 | 8/2018 | Tanaka et al. |
| 2018/0246432 | A1 | 8/2018 | Nishikawa et al. |
| 2018/0329320 | A1 | 11/2018 | Yoshida et al. |
| 2018/0329321 | A1 | 11/2018 | Nakamura et al. |
| 2018/0329322 | A1 | 11/2018 | Kamikura et al. |
| 2018/0329324 | A1 | 11/2018 | Kamikura et al. |
| 2018/0329325 | A1 | 11/2018 | Hatakeyama et al. |
| 2018/0329327 | A1 | 11/2018 | Yamawaki et al. |
| 2018/0329328 | A1 | 11/2018 | Tanaka et al. |
| 2018/0329329 | A1 | 11/2018 | Nakamura et al. |
| 2018/0329332 | A1 | 11/2018 | Tominaga et al. |

OTHER PUBLICATIONS

U.S. Appl. No. 16/253,976, Maho Tanaka, filed Jan. 22, 2019.

"Chemical Handbook, Fundamentals, Revised 5th edition", Author: The Chemical Society of Japan, Publisher: Maruzen Publishing House, ISBN: 978-4-621-07341-4 C 3543, (2013).

TONER

BACKGROUND OF THE INVENTION

Field of the Invention

The present invention relates to the toner employed to develop the electrostatic charge image (electrostatic latent image) used in image-forming methods such as electrophotography, electrostatic printing, and so forth.

Description of the Related Art

The first printout time (FPOT) or first copyout time (FCOT), which is the time required for the output of the first print, has become a point of emphasis for printers and copiers in recent years. Various investigations have thus been carried out in order to shorten FPOT/FCOT. In addition, an enhanced toner cartridge yield has been required in order to lower the toner cartridge replacement frequency and improve the maintenance characteristics.

In order to shorten FPOT/FCOT, a toner is required that exhibits an excellent charge rise performance, i.e., that undergoes rapid charging due to friction with the member that imparts charge to the toner (the charge-imparting member), e.g., a developing roller or carrier. Toner is charged by the movement of charge from the charge-imparting member during contact with the charge-imparting member, e.g., the developing roller or carrier. Thus, an excellent charge rise performance will be exhibited by a toner that engages in numerous contact events with the charge-imparting member and for which the charge undergoes a smooth transfer during contact with the charge-imparting member.

Raising the toner flowability is effective for increasing the number of contact events with the charge-imparting member, while lowering the resistance of the toner is effective for bringing about the smooth transfer of charge during contact with the charge-imparting member. Investigations of toner having metal compound fine particles on the surface have thus been widely pursued in order to improve the charge rise performance by raising the toner flowability and lowering the resistance.

In addition, in order to increase the toner cartridge yield, the toner must have an excellent durability and even during long-term use must exhibit little change in the toner surface and little contamination of the charge-imparting member.

Investigations have therefore been carried out into toner that, through attachment of metal compound fine particles to the surface, exhibits a suppression during long-term use of burying of the metal compound fine particles as well as their migration to the developing roller.

The toner disclosed in Japanese Patent Application Laid-open No. 2004-325756 has an excellent flowability and transfer efficiency and exhibits little burying and migration to the developing roller by the fluidizing agent. This toner has a coating layer formed on the toner particle surface by the adhesion to each other of granular masses containing two or more compounds selected from silicon compounds, aluminum compounds, and titanium compounds.

The toner disclosed in Japanese Patent Application Laid-open No. 2011-102892 has an excellent initial charging performance and can suppress fogging and image density fluctuations even during long-term use. This toner is provided by coating the surface of a toner base particle with a titanium compound and carrying out the external addition of silica and titania to the toner base particle.

SUMMARY OF THE INVENTION

The toner described in Japanese Patent Application Laid-open No. 2004-325756 has excellent properties with regard to flowability and transferability and an excellent behavior in that even during long-term use the fluidizing agent undergoes little burying and little migration to the developing roller.

However, when a high load is applied to the toner, e.g., as in a high-rate charging process, the charging performance of the toner declines due to migration to the developing roller of the titanium compound- and/or aluminum compound-containing granular masses on the toner. In addition, the migrated titanium compound and/or aluminum compound can contaminate the developing roller, causing a reduction in its charge-imparting performance. In such a case, the developing roller contamination and the decline in the toner charging performance prevent the generation of the same charge rise performance as the initial charge rise performance.

The toner described in Japanese Patent Application Laid-open No. 2011-102892, on the other hand, does exhibit an excellent initial charging performance; however, during long-term use the charging performance of this toner declines due to migration of the silica and titania from the toner to the developing roller. In addition, the same charge rise performance as the initial charge rise performance may not be obtained due to contamination of the developing roller by the migrated silica and titania.

It was also confirmed that, when the external addition of silica or alumina was omitted in order to suppress developing roller contamination, the flowability was then inadequate and due to this the charge rise performance was low from the beginning.

That is, the present invention provides a toner that has an excellent charge rise performance and that at the same time exhibits an excellent durability whereby even during long-term use there is little change in the surface state and the occurrence of developing roller contamination is also suppressed.

The present invention relates to a toner having a toner particle having a plurality of fine particles on the surface of a toner base particle, the toner base particle contains a binder resin, wherein a fine particle layer A constituted of the plurality of fine particles is observed in an EDX mapping image of the constituent elements in a cross section of the toner particle as provided by energy dispersive x-ray spectroscopy of the toner particle cross section observed using a transmission electron microscope; a fine particle B, containing a metal compound that contains at least one metal element M selected from all the metal elements belonging to Groups 3 to 13, is observed in the fine particle layer A; and all of the following formulas (1), (2), and (3) are satisfied, $$1.0 \leq D \leq 100.0 \quad (1),$$

$$0.10 \times D \leq H \leq 1.50 \times D \quad (2), \text{ and}$$

$$S \leq 0.50 \times D \quad (3)$$

wherein,

D (nm) is the number-average particle diameter of the fine particle B,

H (nm) is the average value of the thickness of the fine particle layer A, and

S (nm) is the standard deviation on the thickness of the fine particle layer A.

The present invention can thus provide a toner that has an excellent charge rise performance and that at the same time exhibits an excellent durability whereby even during long-term use there is little change in the surface state and the occurrence of developing roller contamination is also suppressed.

Further features of the present invention will become apparent from the following description of exemplary embodiments with reference to the attached drawings.

DESCRIPTION OF THE EMBODIMENTS

Figure 1:
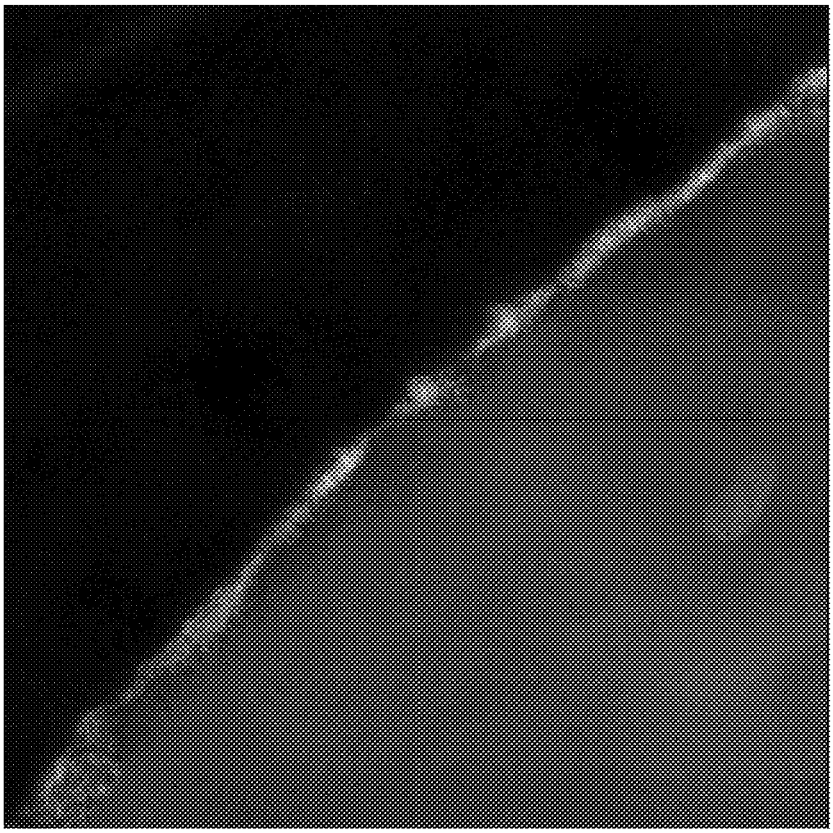
FIG. 1 is an EDX mapping image of the constituent elements in the cross section of a toner particle.

Unless specifically indicated otherwise, the expressions "from XX to YY" and "XX to YY" that show numerical value ranges refer in the present invention to numerical value ranges that include the lower limit and upper limit that are the end points.

The present invention is a toner having a toner particle having a plurality of fine particles on the surface of a toner base particle, the toner base particle contains a binder resin, wherein a fine particle layer A constituted of the plurality of fine particles is observed in an EDX mapping image of the constituent elements in a cross section of the toner particle as provided by energy dispersive x-ray spectroscopy of the toner particle cross section observed using a transmission electron microscope; a fine particle B containing a metal compound containing at least one metal element M selected from all the metal elements belonging to Groups 3 to 13, is observed in the fine particle layer A; and all of the following formulas (1), (2), and (3) are satisfied, $$1.0 \leq D \leq 100.0 \quad (1),$$

$$0.10 \times D \leq H \leq 1.50 \times D \quad (2), \text{ and}$$

$$S \leq 0.50 \times D \quad (3)$$

wherein,

D (nm) is the number-average particle diameter of the fine particle B,

H (nm) is the average value of the thickness of the fine particle layer A, and

S (nm) is the standard deviation on the thickness of the fine particle layer A.

The aforementioned fine particle layer A is defined as follows.

(1) The toner particle cross section is observed with a transmission electron microscope (also referred to as a TEM in the following).

(2) The constituent elements in this toner particle cross section are analyzed using energy dispersive x-ray spectroscopy (also referred to as EDX in the following) and an EDX mapping image is thereby constructed.

(3) A fine particle layer A is defined as being present when, in the contour of the toner particle cross section in this EDX mapping image, signal originating with the constituent elements of the fine particles is observed over at least 80% of the contour of the toner particle cross section.

Observation over at least 90% of the contour of the toner particle cross section is preferred, while continuous observation without interruption over the contour of the toner particle cross section is more preferred. The detailed measurement method is described below.

The aforementioned construction can provide a toner that has an excellent charge rise performance and that at the same time exhibits an excellent durability whereby even during long-term use there is little change in the surface state and the occurrence of developing roller contamination is also suppressed. While the causes of this are unclear, the present inventors hypothesize the following.

The cause of the difficulty with conventional toners of generating a good balance between the charge rise performance and the durability has been that these two properties have resided in a trade-off relationship.

Specifically, when fine particles containing a metal compound (also referred to in the following as metal compound fine particles) have been added to the toner particle in order to improve the flowability and lower the resistance, during long-term use the metal compound fine particles have readily migrated from the toner particle to the developing roller, thus facilitating a change in the state of the toner particle surface.

The metal compound fine particles also have the effect of improving the charging characteristics of toner. On the other hand, a decline in the charge-imparting capacity of the developing roller is readily brought about when the metal compound fine particles adhere to the developing roller. This occurs because the developing roller and toner are generally constituted of materials that readily undergo charging to opposite polarities.

Thus, alterations in the toner particle surface state and contamination of the developing roller have readily occurred during long-term use in the case of toner particles to which metal compound fine particles have been added.

Due to this, fixing the metal compound fine particles on the toner particle surface has also been considered. However, migration to the developing roller due to external forces has readily occurred even when the fine particles have been fixed, and the durability has been inadequate as a result.

The present inventors thought that the facile migration of the metal compound fine particles to the developing roller was due to a nonuniform state of occurrence of the metal compound fine particles on the toner particle surface.

Specifically, when the fine particles are independently present on the toner particle surface, the fine particles then independently receive external forces and the occurrence of burying and migration to the developing roller is facilitated as a consequence.

When, on the other hand, a plurality of fine particles are present in a collection or aggregation, external forces are then dispersed, but some of the fine particles are present in a state of elevation from the toner particle surface and as a consequence migration to the developing roller similarly readily occurs.

That is, in order to inhibit fine particle migration to the developing roller, a fine particle should be brought into a state of contact with other fine particles on the toner particle surface and in combination with this the fine particle should also be brought into a state of contact with the toner particle surface.

When the toner particle has the indicated fine particles on its surface in a state in which a plurality of fine particles comprising metal compound fine particles are in contact with each other, the metal compound fine particles independently present on the toner particle surface can then be reduced.

In addition, migration of the metal compound fine particles to the developing roller can be inhibited by suppressing stacking of the fine particles on the toner particle.

As a consequence of the preceding, a toner can be provided that has an excellent charge rise performance and that exhibits an excellent durability whereby even during long-term use there is little change in the surface state and the occurrence of developing roller contamination is suppressed.

More specifically, a fine particle layer A constituted of the plurality of fine particles is observed in an EDX mapping image of the constituent elements in a cross section of the toner particle as provided by energy dispersive x-ray spectroscopy of the toner particle cross section observed using a transmission electron microscope; a fine particle B, containing a metal compound that contains at least one metal element M selected from all the metal elements belonging to Groups 3 to 13, is observed in the fine particle layer A; and all of the following formulas (1), (2), and (3) are satisfied, $$1.0 \leq D \leq 100.0 \quad (1),$$

$$0.10 \times D \leq H \leq 1.50 \times D \quad (2), \text{ and}$$

$$S \leq 0.50 \times D \quad (3)$$

wherein,

D (nm) is the number-average particle diameter of the fine particle B,

H (nm) is the average value of the thickness of the fine particle layer A, and

S (nm) is the standard deviation on the thickness of the fine particle layer A.

The metal compound fine particles are thought to be not independently present on the toner particle surface when the fine particle layer A is observed to be present. As a result, a toner can be obtained that exhibits an excellent flowability, that supports a suppression of migration by the metal compound fine particles to the developing roller, and that thereby exhibits an excellent durability.

When, on the other hand, the fine particle layer A is not present, numerous metal compound fine particles are then independently present on the toner particle surface and migration of the metal compound fine particles to the developing roller can occur.

The number-average particle diameter D of the fine particle B is from 1.0 nm to 100.0 nm.

When the number-average particle diameter D satisfies the indicated range, a toner can then be obtained that exhibits an excellent flowability, that supports a suppression of migration by the metal compound fine particles to the developing roller, and that thereby exhibits an excellent durability.

The toner flowability is reduced when this number-average particle diameter D is less than 1.0 nm.

On the other hand, migration of the metal compound fine particles to the developing roller can occur when this number-average particle diameter D exceeds 100.0 nm.

Viewed from the standpoint of achieving additional suppression of the migration of the metal compound fine particles to the developing roller, the number-average particle diameter D is preferably from 1.0 nm to 30.0 nm.

When the metal compound fine particles are produced by a reaction, the number-average particle diameter D can be controlled through, for example, the reaction temperature during production. Specifically, the number-average particle diameter D of the metal compound fine particles assumes a declining trend as the reaction temperature is higher. In addition, when the metal compound fine particles are introduced from the outside, control may be exercised by using metal compound fine particles having different number-average particle diameters.

Using H (nm) for the average value of the thickness of the fine particle layer A, this H satisfies the following formula (2). This H preferably satisfies the following formula (2)'.

$$0.10 \times D \leq H \leq 1.50 \times D \quad (2)$$

$$0.50 \times D \leq H \leq 1.50 \times D \quad (2)'$$

When $H \geq 0.10 \times D$ is satisfied, metal compound-containing fine particles are present on the toner particle surface and the fine particle layer A assumes a state of adequate thickness.

When $H \leq 1.50 \times D$ is satisfied, a toner can then be obtained that supports a suppression of migration by the metal compound fine particles to the developing roller and that thereby exhibits an excellent durability.

When, on the other hand, $H > 1.50 \times D$, metal compound fine particles not in contact with the toner particle surface may migrate to the developing roller.

Migration of the metal compound fine particles to the developing roller can be further suppressed when H satisfies the aforementioned (2)'.

The average value H of the thickness of the fine particle layer A can be controlled using, for example, the concentration of the starting materials when the metal compound fine particles are produced. Specifically, the average value H of the thickness of the fine particle layer A assumes an increasing trend as the starting material concentration increases.

Using S (nm) for the standard deviation on the thickness of the fine particle layer A, this S satisfies the following formula (3). This S preferably satisfies the following formula (3)'.

$$S \leq 0.50 \times D \quad (3)$$

$$0.10 \times D \leq S \leq 0.50 \times D \quad (3)'$$

When $S \leq 0.50 \times D$ is satisfied, a toner can then be obtained that supports a suppression of migration by the metal compound fine particles to the developing roller and that thereby exhibits an excellent durability.

When, on the other hand, $S > 0.50 \times D$, metal compound fine particles not in contact with the toner particle surface due to a nonuniform state of occurrence of the metal compound fine particles—may migrate to the developing roller.

When $0.10 \times D \leq S$, a toner having an even better flowability can be obtained due to the presence of unevenness in the toner particle surface.

The standard deviation S on the thickness of the fine particle layer A can be controlled through, for example, the crosslinkability of the starting materials for the metal compound fine particles and the pH during the reaction.

Specifically, the standard deviation S on the thickness of the fine particle layer A assumes an increasing trend as the crosslinkability of the starting materials increases. In addition, the standard deviation S on the thickness of the fine particle layer A assumes an increasing trend as the pH during the reaction is higher.

This D, H, and S more preferably satisfy the following formulas (2)' and (3)'.

$$0.50\times D\leq H\leq 1.50\times D \quad (2)'$$

$$0.10\times D\leq S\leq 0.50\times D \quad (3)'$$

The metal compound is described in detail in the following.

The metal compound contains at least one metal element M selected from all of the metal elements belonging to Groups 3 to 13.

The resistance of the toner is reduced and the charge rise performance of the toner is enhanced by disposing, on the toner particle surface, a metal compound that contains at least one metal element selected from all of the metal elements belonging to Groups 3 to 13.

Specific examples are titanium, zirconium, hafnium, copper, iron, silver, zinc, indium, and aluminum.

The Pauling electronegativity of this metal element is preferably from 1.25 to 1.85 and is more preferably from 1.30 to 1.70.

A metal compound containing a metal element having an electronegativity in the indicated range, in addition to the fact that its hygroscopicity is kept down, exhibits a large polarization within the metal compound and as a consequence the effect on the charge rise performance can be improved still further.

The values provided in "The Chemical Society of Japan (2004): Chemical Handbook, Fundamentals, Revised 5th edition, the table on the back of the front cover, published by Maruzen Publishing House" were used for the Pauling electronegativity.

On the other hand, metal compounds containing only a group 1 or 2 metal element are unstable and their properties readily change due to reaction with moisture in the air or absorption of moisture in the air, and as a consequence their performance readily changes during long-term use.

Specific examples of this metal compound are as follows:

metal salts of phosphoric acid, as represented by reaction products of phosphoric acid and titanium-containing compounds, reaction products of phosphoric acid and zirconium-containing compounds, reaction products of phosphoric acid and aluminum-containing compounds, reaction products of phosphoric acid and copper-containing compounds, and reaction products of phosphoric acid and iron-containing compounds; metal salts of sulfuric acid, as represented by reaction products of sulfuric acid and titanium-containing compounds, reaction products of sulfuric acid and zirconium-containing compounds, and reaction products of sulfuric acid and silver-containing compounds; metal salts of carbonic acid, as represented by reaction products of carbonic acid and titanium-containing compounds, reaction products of carbonic acid and zirconium-containing compounds, and reaction products of carbonic acid and iron-containing compounds; and metal oxides, as represented by alumina (aluminum oxide: $Al_2O_3$), alumina hydrate, titania (titanium oxide: $TiO_2$), strontium titanate ($TiSrO_3$), barium titanate ($TiBaO_3$), zinc oxide (ZnO), iron oxides ($Fe_2O_3$, $Fe_3O_4$), indium oxide ($In_2O_3$), and indium tin oxide.

Preferred among the preceding are the reaction products of a polyhydric acid and a compound containing a metal element as indicated above. This polyhydric acid may be any acid that is at least dibasic. Specific examples are inorganic acids such as phosphoric acid, carbonic acid, and sulfuric acid, and organic acids such as dicarboxylic acids and tricarboxylic acids.

For example, the metal salts of phosphoric acid are preferred because they exhibit high strength due to crosslinking of the phosphate ion through the metal and because they also provide an excellent charge rise performance due to the presence of ionic bonds in the molecule.

The following, for example, are specifically preferred: reaction products of phosphoric acid and titanium-containing compounds, reaction products of phosphoric acid and zirconium-containing compounds, and reaction products of phosphoric acid and aluminum-containing compounds.

The silicon compound is described in detail in the following.

The toner particle preferably contains a silicon compound on its surface.

Due to its low surface free energy, the silicon compound improves the toner flowability and further enhances the charge rise performance.

The silicon compound preferably is a condensate of an organosilicon compound represented by formula (A) below. The condensate of an organosilicon compound represented by formula (A) exhibits crosslinkability and as a consequence can further suppress migration of the metal compound fine particles to the developing roller. The condensate also has a high hydrophobicity, and has a good charge-imparting property under a high-humidity environment.

In addition, the aforementioned fine particles preferably contain a condensate of the indicated organosilicon compound.

$$Ra_{(n)}\text{—}Si\text{—}Rb_{(4-n)} \quad (A)$$

Where, each Ra independently represents a halogen atom or an alkoxy group (preferably having 1 to 4 carbons and more preferably 1 to 3 carbons), and each Rb independently represents an alkyl group (preferably having 1 to 8 carbons and more preferably 1 to 6 carbons), an alkenyl group (preferably having 1 to 6 carbons and more preferably 1 to 4 carbons), an aryl group (preferably having 6 to 14 carbons and more preferably 6 to 10 carbons), an acyl group (preferably having 1 to 6 carbons and more preferably 1 to 4 carbons), or a methacryloxyalkyl group (preferably the methacryloxypropyl group).

n represents an integer of 2 or 3.

The organosilicon compound represented by formula (A) can be exemplified by various difunctional and trifunctional silane compounds.

The difunctional silane compounds can be specifically exemplified by dimethyldimethoxysilane and dimethyldiethoxysilane.

The trifunctional silane compounds can be exemplified by the following compounds:

trifunctional methylsilane compounds such as methyltrimethoxysilane, methyltriethoxysilane, methyldiethoxymethoxysilane, and methylethoxydimethoxysilane;

trifunctional silane compounds such as ethyltrimethoxysilane, ethyltriethoxysilane, propyltrimethoxysilane, propyltriethoxysilane, butyltrimethoxysilane, butyltriethoxysilane, hexyltrimethoxysilane, and hexyltriethoxysilane;

trifunctional phenylsilane compounds such as phenyltrimethoxysilane and phenyltriethoxysilane;

trifunctional vinylsilane compounds such as vinyltrimethoxysilane and vinyltriethoxysilane;

trifunctional allylsilane compounds such as allyltrimethoxysilane, allyltriethoxysilane, allyldiethoxymethoxysilane, and allyl ethoxydimethoxysilane; and trifunctional γ-methacryloxypropylsilane compounds such as γ-methacryloxypropyltrimethoxysilane, γ-methacryloxypropyltriethoxysilane, γ-methacryloxypropyldiethoxymethoxysilane, and γ-methacryloxypropylethoxydimethoxysilane.

Among the preceding, silane compounds represented by the following formula (B) exhibit a high crosslinkability and as a consequence can further suppress migration of the metal compound fine particles to the developing roller. They are also more preferred because they support facile control of the standard deviation S on the thickness of the aforementioned signal layer into a favorable range.

$$Ra_3—Si—Rb_1 \quad (B)$$

Where, each Ra independently represents a halogen atom or an alkoxy group, and each Rb independently represents an alkyl group, alkenyl group, aryl group, acyl group, or methacryloxyalkyl group.

The silane compound represented by formula (B) can be specifically exemplified by the trifunctional silane compounds described above.

The amount in the toner particle of the organosilicon compound condensate is preferably from 0.01 mass % to 20.0 mass % and is more preferably from 0.1 mass % to 10.0 mass %.

The charge rise performance is further improved when the amount of the organosilicon compound condensate is in the indicated range. This amount can be controlled through the amount of organosilicon compound used as the starting material.

The toner particle contains a binder resin.

This binder resin can be exemplified by vinyl resins, polyester resins, polyurethane resins, and polyamide resins.

The polymerizable monomer that can be used to produce the vinyl resin can be exemplified by the following: styrene and styrenic monomers such as α-methyl styrene;

acrylate esters such as methyl acrylate and butyl acrylate; methacrylate esters such as methyl methacrylate, 2-hydroxyethyl methacrylate, t-butyl methacrylate, and 2-ethylhexyl methacrylate;

unsaturated carboxylic acids such as acrylic acid and methacrylic acid;

unsaturated dicarboxylic acids such as maleic acid;

unsaturated dicarboxylic acid anhydrides such as maleic anhydride;

nitrile-type vinyl monomers such as acrylonitrile; halogenated vinyl monomers such as vinyl chloride; and nitro-type vinyl monomers such as nitrostyrene.

Among the preceding, the binder resin preferably contains a vinyl resin and a polyester resin. Polyester resins have a high affinity for the metal compound fine particles and as a result facilitate suppression of migration by the metal compound fine particles to the developing roller. In addition, they engage in a smooth charge transfer with the metal compound fine particles and as a consequence support a sharp charge quantity distribution in the toner.

The amount of the polyester resin in the binder resin is preferably at least 1.0 mass %.

Heretofore known monomers may be used without particular limitation as the polymerizable monomer when the binder resin is obtained by, for example, an emulsion aggregation method or a suspension polymerization method.

Specific examples in this regard are the vinyl monomers provided as examples in the section on the binder resin.

A known polymerization initiator may be used without particular limitation as the polymerization initiator.

The following are specific examples:

peroxide-type polymerization initiators such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, pertriphenylacetic acid-tert-hydroperoxide, tert-butyl performate, tert-butyl peracetate, tert-butyl perbenzoate, tert-butyl perphenylacetate, tert-butyl permethoxyacetate, per-N-(3-tolyl)palmitic acid-tert-butylbenzoyl peroxide, t-butyl peroxy-2-ethylhexanoate, t-butyl peroxypivalate, t-butyl peroxyisobutyrate, t-butyl peroxyneodecanoate, methyl ethyl ketone peroxide, diisopropyl peroxycarbonate, cumene hydroperoxide, 2,4-dichlorobenzoyl peroxide, and lauroyl peroxide; and azo and diazo polymerization initiators as represented by 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

The toner particle may contain a colorant. The heretofore known magnetic bodies and pigments and dyes in the colors of black, yellow, magenta, and cyan as well as in other colors may be used without particular limitation as this colorant.

The black colorant can be exemplified by black pigments such as carbon black.

The yellow colorant can be exemplified by yellow pigments and yellow dyes, e.g., monoazo compounds, disazo compounds, condensed azo compounds, isoindolinone compounds, benzimidazolone compounds, anthraquinone compounds, azo metal complexes, methine compounds, and allylamide compounds.

Specific examples are C. I. Pigment Yellow 74, 93, 95, 109, 111, 128, 155, 174, 180, and 185 and C. I. Solvent Yellow 162.

The magenta colorants can be exemplified by magenta pigments and magenta dyes, e.g., monoazo compounds, condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Specific examples are C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, and 269, and C. I. Pigment Violet 19.

The cyan colorants can be exemplified by cyan pigments and cyan dyes, e.g., copper phthalocyanine compounds and derivatives thereof, anthraquinone compounds, and basic dye lake compounds.

Specific examples are C. I. Pigment Blue 1, 7, 15, 15:1, 15:2, 15:3, 15:4, 60, 62, and 66.

The colorant amount, considered per 100.0 mass parts of the binder resin or polymerizable monomer, is preferably from 1.0 mass parts to 20.0 mass parts.

The toner may also be made into a magnetic toner by the incorporation of a magnetic body.

In this case, the magnetic body may also function as a colorant.

The magnetic body can be exemplified by iron oxides as represented by magnetite, hematite, and ferrite; metals as represented by iron, cobalt, and nickel; alloys of these metals with a metal such as aluminum, cobalt, copper, lead, magnesium, tin, zinc, antimony, beryllium, bismuth, cadmium, calcium, manganese, selenium, titanium, tungsten, and vanadium; and mixtures thereof.

The toner particle may contain a wax. This wax can be exemplified by the following:

esters between a monohydric alcohol and a monocarboxylic acid, e.g., behenyl behenate, stearyl stearate, and palmityl palmitate;

esters between a dibasic carboxylic acid and a monoalcohol, e.g., dibehenyl sebacate;

esters between a dihydric alcohol and a monocarboxylic acid, e.g., ethylene glycol distearate and hexanediol dibehenate;

esters between a trihydric alcohol and a monocarboxylic acid, e.g., glycerol tribehenate;

esters between a tetrahydric alcohol and a monocarboxylic acid, e.g., pentaerythritol tetrastearate and pentaerythritol tetrapalmitate;

esters between a hexahydric alcohol and a monocarboxylic acid, e.g., dipentaerythritol hexastearate and dipentaerythritol hexapalmitate;

esters between a polyfunctional alcohol and a monocarboxylic acid, e.g., polyglycerol behenate;

natural ester waxes such as carnauba wax and rice wax;

petroleum-based hydrocarbon waxes, e.g., paraffin wax, microcrystalline wax, and petrolatum, and derivatives thereof;

hydrocarbon waxes provided by the Fischer-Tropsch method and derivatives thereof;

polyolefin-type hydrocarbon waxes, e.g., polyethylene wax and polypropylene wax, and their derivatives; higher aliphatic alcohols;

fatty acids such as stearic acid and palmitic acid; and acid amide waxes.

From the standpoint of the release performance, the wax amount, considered per 100.0 mass parts of the binder resin or polymerizable monomer, is preferably from 1.0 mass parts to 30.0 mass parts and is more preferably from 5.0 mass parts to 20.0 mass parts.

The toner particle may contain a charge control agent. The heretofore known charge control agents may be used without particular limitation as this charge control agent.

Negative-charging charge control agents can be specifically exemplified by metal compounds of aromatic carboxylic acids such as salicylic acid, alkylsalicylic acid, dialkylsalicylic acid, naphthoic acid, and dicarboxylic acids, and by polymers and copolymers that contain such a metal compound of an aromatic carboxylic acid;

polymers and copolymers bearing a sulfonic acid group, sulfonate salt group, or sulfonate ester group;

metal salts and metal complexes of azo dyes and azo pigments; and boron compounds, silicon compounds, and calixarene.

The positive-charging charge control agents, on the other hand, can be exemplified by quaternary ammonium salts and polymeric compounds that have a quaternary ammonium salt in side chain position; guanidine compounds; nigrosine compounds; and imidazole compounds.

The polymers and copolymers that have a sulfonate salt group or sulfonate ester group can be exemplified by homopolymers of a sulfonic acid group-containing vinyl monomer such as styrenesulfonic acid, 2-acrylamido-2-methylpropanesulfonic acid, 2-methacrylamido-2-methylpropanesulfonic acid, vinylsulfonic acid, and methacrylsulfonic acid, and by copolymers of these sulfonic acid group-containing vinyl monomers with other vinyl monomer as indicated in the section on the binder resin.

The charge control agent amount, considered per 100.0 mass parts of the binder resin or polymerizable monomer, is preferably from 0.01 mass parts to 5.0 mass parts.

Even in the absence of an external additive, the toner particle exhibits properties such as an excellent flowability due to the presence on its surface of the metal compound-containing fine particles. However, an external additive may be incorporated with the goal of achieving additional improvements.

The heretofore known external additives may be used without particular limitation as this external additive.

Specific examples are as follows: base silica fine particles, e.g., silica produced by a wet method, silica produced by a dry method, and so forth; silica fine particles provided by subjecting such base silica fine particles to a surface treatment with a treatment agent such as a silane coupling agent, titanium coupling agent, silicone oil, and so forth; and resin fine particles such as vinylidene fluoride fine particles, polytetrafluoroethylene fine particles, and so forth.

The amount of the external additive is preferably from 0.1 mass parts to 5.0 mass parts per 100.0 mass parts of the toner particle.

Methods for producing the toner are described in detail in the following.

While there are no particular limitations on the method for producing the toner particle, the toner particle having metal compound-containing fine particles may be produced by the following first production method or second production method.

The first production method is a method in which the toner particle is obtained by reacting, in an aqueous medium in which a toner base particle is dispersed, acid or water with a metal source that is a starting material for the metal compound fine particles; precipitating the metal compound as fine particles; and bringing about attachment to the toner base particle.

The second production method is a method in which the toner particle is obtained by adding metal compound fine particles to an aqueous medium in which a toner base particle is dispersed and bringing about attachment to the toner base particle.

Heretofore known metal compounds may be used without particular limitation as the metal source when the toner is obtained by the first production method. The following are specific examples:

metal chelate compounds as represented by titanium diisopropoxybisacetylacetonate, titanium tetraacetylacetonate, titanium diisopropoxybis(ethyl acetoacetate), titanium di-2-ethylhexoxybis(2-ethyl-3-hydroxyhexoxide), titanium diisopropoxybis(ethyl acetoacetate), titanium lactate, ammonium salt of titanium lactate, titanium diisopropoxybistriethanolaminate, titanium isostearate, titanium aminoethylaminoethanolate, and titanium triethanolaminate, zirconium tetraacetylacetonate, zirconium tributoxymonoacetylacetonate, zirconium dibutoxybis(ethyl acetoacetate), zirconium lactate, and the ammonium salt of zirconium lactate, aluminum lactate, the ammonium salt of aluminum lactate, aluminum trisacetylacetonate, aluminum bis(ethyl acetoacetate)monoacetylacetonate, and aluminum tris(ethyl acetoacetate), iron(II) lactate, copper(II) lactate, and silver(I) lactate;

metal alkoxide compounds as represented by tetraisopropyl titanate, tetrabutyl titanate, tetraoctyl titanate, zirconium tetrapropoxide, zirconium tetrabutoxide, aluminum secondary-butoxide, aluminum isopropoxide, trisisopropoxyiron, and tetraisopropoxyhafnium; and metal halides such as titanium chloride, zirconium chloride, and aluminum chloride.

Among the preceding, the use of metal chelate compounds is preferred because metal chelate compounds, by inhibiting aggregation of the metal compound fine particles by restraining the reaction rate, facilitate obtaining toner that satisfies the stipulations of the present invention.

Titanium lactate, the ammonium salt of titanium lactate, zirconium lactate, the ammonium salt of zirconium lactate, aluminum lactate, and the ammonium salt of aluminum lactate are more preferred.

Heretofore known acids may be used without particular limitation as the acid when the toner is obtained by the first production method. The following are specific examples:

inorganic polyhydric acids as represented by phosphoric acid, carbonic acid, and sulfuric acid;

inorganic monobasic acids as represented by nitric acid;

organic polyhydric acids as represented by oxalic acid, malonic acid, succinic acid, glutaric acid, adipic acid, fumaric acid, maleic acid, pimelic acid, suberic acid, azelaic acid, sebacic acid, phthalic acid, isophthalic acid, and terephthalic acid; and organic monobasic acids as represented by formic acid, acetic acid, benzoic acid, and trifluoroacetic acid.

Among the preceding, the use of inorganic polyhydric acids is preferred because inorganic polyhydric acids provide an excellent durability due to the generation of very strong metal compound fine particles through crosslinking through the metal atoms.

The use of the phosphate ion is more preferred. This acid may be used as such as the acid, or may be used in the form of the alkali metal salt with, e.g., sodium, potassium, or lithium; the alkaline-earth metal salt with, e.g., magnesium, calcium, strontium, or barium; or the ammonium salt.

When, in the first and second production methods, a condensation reaction is carried out on the organosilicon compound at the same time as attachment of the metal compound fine particles to the toner base particle, aggregation of the metal compound fine particles is then inhibited and in combination with this the metal compound fine particles can be fixed to the toner base particle.

In this case, the metal compound fine particles (fine particle B) contain silicon and at least one metal element selected from all of the metal elements belonging to Groups 3 to 13.

Specifically, the organosilicon compound represented by the preceding formula (A) first is hydrolyzed in advance or is hydrolyzed in the toner base particle dispersion.

The resulting organosilicon compound hydrolyzate is subsequently condensed to provide a condensate.

This condensate transfers to the surface of the toner base particle. This condensate has a viscous or sticky character, and due to this the metal compound fine particles are adhered to the toner base particle surface and the metal compound fine particles can then be more strongly fixed to the toner base particle.

This condensate also transfers to the surface of the metal compound fine particles and can thus hydrophobe the metal compound fine particles and bring about an improvement in the environmental stability.

The condensation reaction of organosilicon compounds is known to be pH dependent, and the pH of the aqueous medium is preferably from 6.0 to 12.0 in order for condensation to proceed.

Adjustment of the pH of the aqueous medium or mixture may be controlled using an existing acid or base. Acids for adjusting the pH can be exemplified by the following:

hydrochloric acid, hydrobromic acid, hydroiodic acid, perbromic acid, meta-periodic acid, permanganic acid, thiocyanic acid, sulfuric acid, nitric acid, phosphonic acid, phosphoric acid, diphosphoric acid, hexafluorophosphoric acid, tetrafluoroboric acid, tripolyphosphoric acid, aspartic acid, o-aminobenzoic acid, p-aminobenzoic acid, isonicotinic acid, oxaloacetic acid, citric acid, 2-glycerolphosphoric acid, glutamic acid, cyanoacetic acid, oxalic acid, trichloroacetic acid, o-nitrobenzoic acid, nitroacetic acid, picric acid, picolinic acid, pyruvic acid, fumaric acid, fluoroacetic acid, bromoacetic acid, o-bromobenzoic acid, maleic acid, and malonic acid.

Among the preceding, the use of acids having a low reactivity with the metal compound is preferred because this enables the efficient production of the metal compound fine particles.

The following are examples of bases for adjusting the pH:

alkali metal hydroxides such as potassium hydroxide, sodium hydroxide, and lithium hydroxide, and their aqueous solutions; alkali metal carbonates such as potassium carbonate, sodium carbonate, and lithium carbonate, and their aqueous solutions; alkali metal sulfates such as potassium sulfate, sodium sulfate, and lithium sulfate, and their aqueous solutions; alkali metal phosphates such as potassium phosphate, sodium phosphate, and lithium phosphate, and their aqueous solutions; alkaline-earth metal hydroxides such as calcium hydroxide and magnesium hydroxide, and their aqueous solutions; ammonia; basic amino acids such as histidine, arginine, and lysine, and their aqueous solutions; and trishydroxymethylaminomethane.

A single acid may be used by itself or two or more may be used in combination, and a single base may be used by itself or two or more may be used in combination.

The method for producing the toner base particle is not particularly limited, and a known suspension polymerization method, dissolution suspension method, emulsion aggregation method, pulverization method, and so forth can be used.

When the toner base particle is produced in an aqueous medium, this may be used as such as an aqueous dispersion, or washing, filtration, drying, and then redispersion in an aqueous medium may be carried out.

When the toner base particle has been produced by a dry method, dispersion of the toner base particle in an aqueous medium may be carried out using a known method. The aqueous medium preferably contains a dispersion stabilizer in order to effect dispersion of the toner base particle in the aqueous medium.

The method of obtaining the toner base particle by suspension polymerization is described in the following as an example.

First, the polymerizable monomer that will produce the binder resin is mixed with any optional additives, and, using a disperser, a polymerizable monomer composition is prepared in which these materials are dissolved or dispersed.

The additives can be exemplified by colorants, waxes, charge control agents, polymerization initiators, chain transfer agents, and so forth.

The disperser can be exemplified by homogenizers, ball mills, colloid mills, and ultrasound dispersers.

The polymerizable monomer composition is then introduced into an aqueous medium that contains sparingly water-soluble inorganic fine particles, and droplets of the polymerizable monomer composition are prepared using a high-speed disperser such as a high-speed stirrer or an ultrasound disperser (granulation step).

The toner base particle is then obtained by polymerizing the polymerizable monomer in the droplets (polymerization step).

The polymerization initiator may be admixed during the preparation of the polymerizable monomer composition or may be admixed into the polymerizable monomer composition immediately prior to the formation of the droplets in the aqueous medium.

In addition, it may also be added, optionally dissolved in the polymerizable monomer or another solvent, during granulation into the droplets or after the completion of granulation, i.e., immediately before the initiation of the polymerization reaction.

After the binder resin has been obtained by the polymerization of the polymerizable monomer, the toner base particle dispersion may be obtained by the optional execution of a solvent removal process.

The methods for measuring the various property values are described in the following.

Method for Measuring Number-Average Particle Diameter D of Metal Compound-Containing Fine Particle B, Average Value H of Thickness of Fine Particle Layer A, and Standard Deviation S on Thickness of Fine Particle Layer A The cross section of the toner particle is observed with a transmission electron microscope (TEM) using the following method.

The toner particle is thoroughly dispersed in a normal temperature-curable epoxy resin followed by curing for 2 days in a 40° C. atmosphere.

50 nm-thick thin section samples are sliced from the resulting cured material using a microtome equipped with a diamond blade (EM UC7, Leica).

The toner particle cross section is observed using a TEM (Model JEM2800, JEOL Ltd.) and enlarging this sample 500,000× using conditions of an acceleration voltage of 200 V and an electron beam probe size of 1 mm. Toner particle cross sections are selected that have a maximum diameter that is 0.9-times to 1.1-times the number-average particle diameter (D1) measured on the same toner according to the method described below for measuring the number-average particle diameter (D1) of the toner particle. The constituent elements of the obtained toner particle cross sections are analyzed using energy dispersive x-ray spectroscopy (EDX) and an EDX mapping image (256×256 pixels (2.2 nm/pixel), number of cumulations=200) is constructed (refer to FIG. 1).

A fine particle layer is regarded as being present when, in the resulting EDX mapping image, a signal originating with the constituent elements of the fine particle is observed at the contour of the toner particle cross section over at least 80% of the contour of the toner particle cross section, and the observed layer is designated fine particle layer A. In addition, the metal compound-containing fine particles present in the fine particle layer A are designated fine particle B.

The cross sections of 20 toner particles are observed using this method and the presence/absence of the fine particle layer A is checked.

Figure 2:
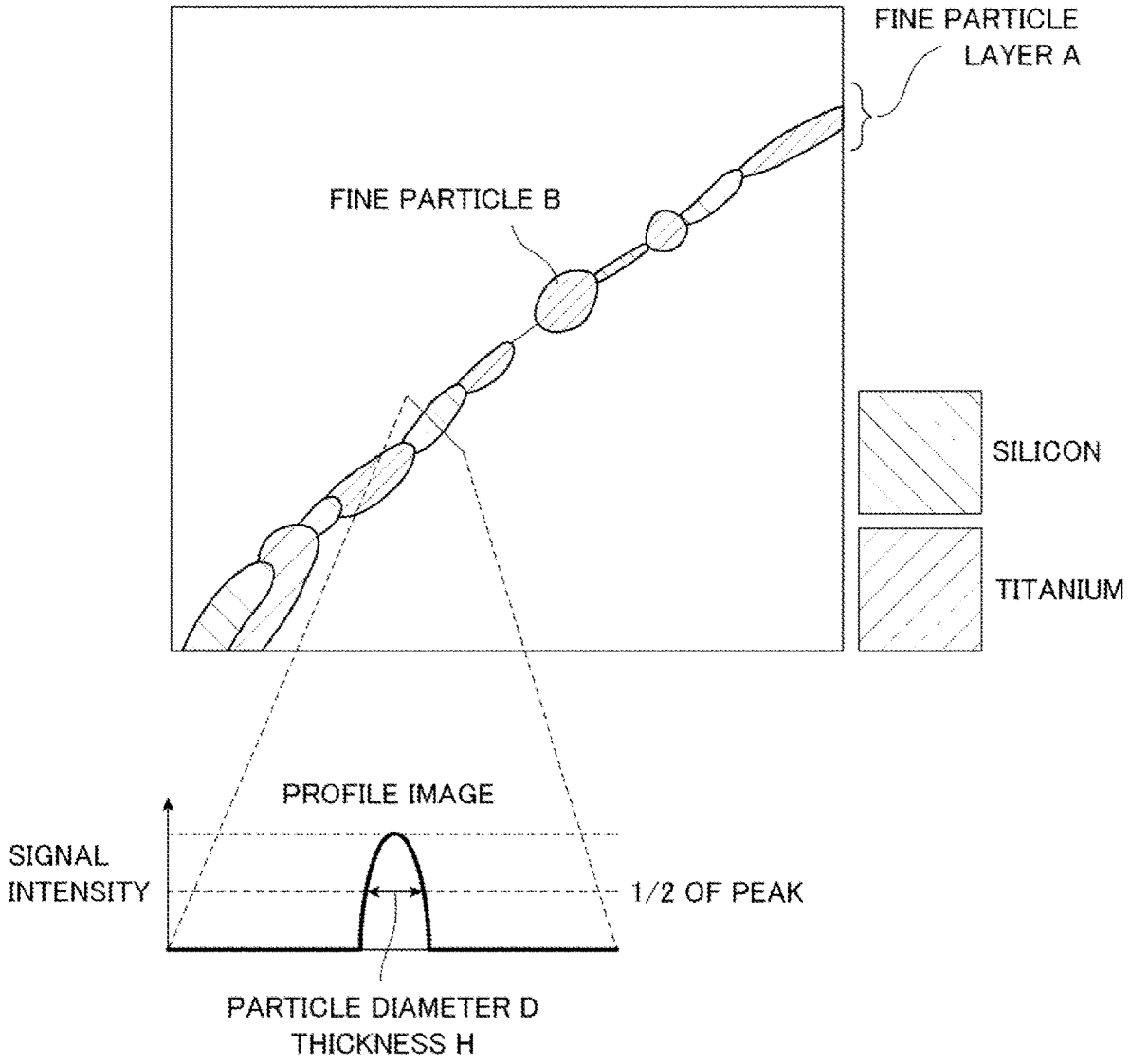
FIG. 2 is a schematic representation of the EDX mapping image in FIG. 1.

When a fine particle layer A is present, the EDS intensity line profile is extracted along the largest diameter (nm) of each fine particle B and the full width at half maximum of the profile is taken to be the diameter of the fine particle B. The fine particle B diameter is measured on the EDX mapping image of 20 toners and the resulting arithmetic average is taken to be the number-average particle diameter D (nm) (refer to FIG. 2).

On the other hand, the EDS intensity line profile in the direction perpendicular to the toner particle surface is extracted for the fine particle layer A, and the full width at half maximum of the profile is taken to be the thickness of the fine particle layer A. During this, the thickness is taken to be 0 nm at locations where no signal is measured. For each toner particle, the thickness of the fine particle layer A is measured at 10 equal divisions of the contour of the toner particle cross section (refer to FIG. 2).

20 toner particle cross sections are analyzed using this procedure; the thickness of the fine particle layer A and its standard deviation is determined for each individual toner particle; and the numerical values provided by calculating their arithmetic averages are taken to be the average value H (nm) of the thickness of the fine particle layer A and the standard deviation S (nm) on the thickness of the fine particle layer A.

Amount of Silicon Compound in Toner

The amount of the silicon compound in the toner was measured using the following method.

An "Axios" wavelength-dispersive x-ray fluorescence analyzer (PANalytical B.V.) is used for the amount of the silicon compound, and the "SuperQ ver. 4.0F" (PANalytical B.V.) software provided therewith is used in order to set the measurement conditions and analyze the measurement data.

Rh is used for the x-ray tube anode; a vacuum is used for the measurement atmosphere; the measurement diameter (collimator mask diameter) is 27 mm; and the measurement time is 10 seconds.

A proportional counter (PC) is used in the case of measurement of the light elements, and a scintillation counter (SC) is used in the case of measurement of the heavy elements.

4 g of the toner is introduced into a specialized aluminum compaction ring and is smoothed over, and, using a "BRE-32" tablet compression molder (Maekawa Testing Machine Mfg. Co., Ltd.), a pellet is produced by molding to a thickness of 2 mm and a diameter of 39 mm by compression for 60 seconds at 20 MPa, and this pellet is used as the measurement sample.

Silica ($SiO_2$) fine powder is added, so as to be 0.01 mass % of the total toner, to the toner not containing silicon compound, and thorough mixing is performed using a coffee mill.

0.05 mass %, 0.1 mass %, 0.5 mass %, 1.0 mass %, 5.0 mass %, 10.0 mass %, and 20.0 mass % of the silica fine powder are each likewise mixed with the toner, and these are used as samples for construction of a calibration curve.

For each of these samples, a pellet of the sample for calibration curve construction is fabricated proceeding as above using the tablet compression molder, and the count rate (unit: cps) is measured for the Si-Kα radiation observed at a diffraction angle (2θ)=109.08° using pentaerythritol (PET) for the analyzer crystal.

In this case, the acceleration voltage and current value for the x-ray generator are, respectively, 24 kV and 100 mA.

A calibration curve in the form of a linear function is obtained by placing the obtained x-ray count rate on the vertical axis and the amount of $SiO_2$ addition to each calibration curve sample on the horizontal axis.

The toner to be analyzed is then made into a pellet proceeding as above using the tablet compression molder and is subjected to measurement of its Si—Kα radiation count rate. The amount of the silicon compound in the toner is determined from the aforementioned calibration curve.

In the case of a sample to which silica particles had been added, all of the added silica particles were assumed to be contained in the toner and the silicon compound amount was obtained by subtracting the amount of silica particle addition from the obtained silicon compound amount.

Method for Measuring Weight-average Particle Diameter (D4) and Number-average Particle Diameter (D1)

The weight-average particle diameter (D4) and number-average particle diameter (D1) of the toner, toner particle, and toner base particle (also referred to below as, for example, toner) is determined proceeding as follows.

The measurement instrument used is a "Coulter Counter Multisizer 3" (registered trademark, Beckman Coulter, Inc.), a precision particle size distribution measurement instrument operating on the pore electrical resistance method and equipped with a 100-μm aperture tube.

The measurement conditions are set and the measurement data are analyzed using the accompanying dedicated software, i.e., "Beckman Coulter Multisizer 3 Version 3.51" (Beckman Coulter, Inc.). The measurements are carried out in 25,000 channels for the number of effective measurement channels.

The aqueous electrolyte solution used for the measurements is prepared by dissolving special-grade sodium chloride in deionized water to provide a concentration of 1.0% and, for example, "ISOTON II" (Beckman Coulter, Inc.) can be used.

The dedicated software is configured as follows prior to measurement and analysis.

In the "modify the standard operating method (SOMME)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the "threshold value/noise level measurement button". In addition, the current is set to 1,600 μA; the gain is set to 2; the electrolyte solution is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) 200.0 mL of the aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture tube flush" function of the dedicated software.

(2) 30.0 mL of the aqueous electrolyte solution is introduced into a 100-mL flatbottom glass beaker. To this is added as dispersing agent 0.3 mL of a dilution prepared by the three-fold (mass) dilution with deionized water of "Contaminon N" (a 10% aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetra 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. 3.3 L of deionized water is introduced into the water tank of the ultrasound disperser and 2.0 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, 10 mg of the, e.g., toner, is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 10° C. to 40° C.

(6) Using a pipette, the aqueous electrolyte solution prepared in (5) and containing, e.g., dispersed toner, is dripped into the roundbottom beaker set in the sample stand as described in (1) with adjustment to provide a measurement concentration of 5%. Measurement is then performed until the number of measured particles reaches 50,000.

(7) The measurement data is analyzed by the previously cited dedicated software provided with the instrument and the weight-average particle diameter (D4) and the number-average particle diameter (D1) are calculated. When set to graph/volume % with the dedicated software, the "average diameter" on the "analysis/volumetric statistical value (arithmetic average)" screen is the weight-average particle diameter (D4). When set to graph/number % with the dedicated software, the "average diameter" on the "analysis/numerical statistical value (arithmetic average)" screen is the number-average particle diameter (D1).

Method for Measuring Glass Transition Temperature (Tg)

The glass transition temperature (Tg) of, e.g., the toner base particle or resin, is measured using a "Q1000" differential scanning calorimeter (TA Instruments) in accordance with ASTM D 3418-82.

The melting points of indium and zinc are used for temperature correction in the instrument detection section, and the heat of fusion of indium is used for correction of the amount of heat.

Specifically, a 10 mg sample is exactly weighed out and this is introduced into an aluminum pan; an empty aluminum pan is used for reference. The measurement is run at a ramp rate of 10° C./min in the measurement temperature range from 30° C. to 200° C.

In the measurement, heating is carried out to 200° C., followed by cooling to 30° C. at a ramp down rate of 10° C./min and then reheating.

The change in the specific heat in the temperature range of 40° C. to 100° C. is obtained in this second heating process. The glass transition temperature (Tg) is taken to be the point at the intersection between the differential heat curve and the line for the midpoint for the baselines for prior to and subsequent to the appearance of the change in the specific heat.

EXAMPLES

The present invention is specifically described below using examples and comparative examples, but the present invention is not limited to or by these. Unless specifically indicated otherwise, the "parts" and "%" used in the examples and comparative examples are on a mass basis in all instances.

Organosilicon Compound Solution Production Example

| | |
|---|---|
| deionized water | 80.0 parts |
| methyltriethoxysilane | 20.0 parts |

These materials were weighed into a 200-mL beaker and the pH was adjusted to 3.5 using 10% hydrochloric acid. This was followed by stirring for 1.0 hour while heating to 60° C. in a water bath to produce an organosilicon compound solution 1. Organosilicon compound solutions 2 to 7 were produced with the type of organosilicon compound being changed as indicated in Table 1.

TABLE 1

| | Compound name | Abbreviation |
|---|---|---|
| Organosilicon compound solution 1 | Methyltriethoxysilane | MTES |
| Organosilicon compound solution 2 | Vinyltriethoxysilane | VTES |
| Organosilicon compound solution 3 | Propyltrimethoxysilane | PTMS |
| Organosilicon compound solution 4 | Phenyltrimethoxysilane | PhTMS |
| Organosilicon compound solution 5 | Dimethyldiethoxysilane | DMDES |
| Organosilicon compound solution 6 | Trimethylethoxysilane | TMES |
| Organosilicon compound solution 7 | Tetraethoxysilane | TEOS |

Toner Base Particle Dispersion 1 Production Example

Aqueous Medium 1 Production

| | |
|---|---|
| deionized water | 390.0 parts |
| sodium phosphate (dodecahydrate) | 14.0 parts |

These materials were introduced into a reactor and were held for 1.0 hour at 65° C. while carrying out a nitrogen purge.

An aqueous calcium chloride solution of 9.2 parts of calcium chloride (dihydrate) dissolved in 10.0 parts of deionized water was introduced all at once while stirring at 12,000 rpm using a T. K. Homomixer (Tokushu Kika Kogyo Co., Ltd.) to prepare an aqueous medium containing a dispersion stabilizer. The pH was adjusted to 6.0 by the addition of 1 mol/L hydrochloric acid, thus yielding aqueous medium 1.

Polymerizable Monomer Composition 1 Production Example

| | |
|---|---|
| styrene | 60.0 parts |
| C.I. Pigment Blue 15:3 | 6.5 parts |

These materials were introduced into an attritor (Nippon Coke & Engineering Co., Ltd.) and dispersion was carried out for 5.0 hours at 220 rpm using zirconia particles with a diameter of 1.7 mm to prepare a colorant dispersion in which the pigment was dispersed.

The following materials were added to this colorant dispersion.

| | |
|---|---|
| styrene | 20.0 parts |
| n-butyl acrylate | 20.0 parts |

-continued

| | |
|---|---|
| polyester resin (condensate of bisphenol A-2 mol propylene oxide adduct/terephthalic acid/trimellitic acid, glass transition temperature Tg: 75° C., acid value: 8.0 mg KOH/g) | 5.0 parts |
| Fischer-Tropsch wax (melting point: 78° C.) | 7.0 parts |

This material was then held at 65° C. and a polymerizable monomer composition 1 was prepared by dissolving and dispersing to uniformity at 500 rpm using a T. K. Homomixer.

Granulation Step

While holding the temperature of aqueous medium 1 at 70° C. and the stirrer rotation rate at 12,000 rpm, the polymerizable monomer composition 1 was introduced into the aqueous medium 1 and 9.0 parts of the polymerization initiator t-butyl peroxypivalate was added. Granulation was performed in this state for 10 minutes while maintaining 12,000 rpm with the stirrer.

Polymerization Step

The high-speed stirrer was replaced with a stirrer equipped with a propeller impeller and polymerization was carried out for 5.0 hours while maintaining 70° C. and stirring at 150 rpm. An additional polymerization reaction was run by raising the temperature to 85° C. and heating for 2.0 hours. Deionized water was added to adjust the toner base particle concentration in the dispersion to 20.0%, thus yielding toner base particle dispersion 1 in which toner base particle 1 was dispersed.

Toner base particle 1 had a weight-average particle diameter (D4) of 6.7 μm, a number-average particle diameter (D1) of 5.6 μm, and a glass transition temperature (Tg) of 56° C.

Toner Base Particle Dispersion 2 Production Example

Aqueous Medium 2 Production

| | |
|---|---|
| deionized water | 370.0 parts |
| sodium hydroxide | 9.6 parts |

These materials were introduced into a reactor and were held for 1.0 hour at 65° C. while carrying out a nitrogen purge.

An aqueous magnesium chloride solution of 24.4 parts of magnesium chloride (hexahydrate) dissolved in 30.0 parts of deionized water was introduced all at once while stirring at 12,000 rpm using a T. K. Homomixer to prepare an aqueous medium 2 containing a dispersion stabilizer. The pH was adjusted to 9.5 by the addition of a 1 mol/L aqueous sodium hydroxide solution, thus yielding aqueous medium 2.

A toner base particle dispersion 2 was obtained proceeding as in the Toner Base Particle Dispersion 1 Production Example, but using the aqueous medium 2 in place of the aqueous medium 1 as the aqueous medium.

Toner base particle 2 had a weight-average particle diameter (D4) of 6.9 μm, a number-average particle diameter (D1) of 5.8 μm, and a glass transition temperature (Tg) of 56° C.

Toner Base Particle Dispersion 3 Production Example

A toner base particle dispersion 3 was obtained proceeding as in the Toner Base Particle Dispersion 1 Production Example, but using 1.0 part of Bontron E-84 (Orient Chemical Industries Co., Ltd.) in place of the polyester resin.

Toner base particle 3 had a weight-average particle diameter (D4) of 7.5 μm, a number-average particle diameter (D1) of 6.4 μm, and a glass transition temperature (Tg) of 56° C.

Toner Particle 1 Production Example

The following materials were weighed into a reactor and mixed using a propeller impeller.

| | |
|---|---|
| toner base particle dispersion 1 | 500.0 parts |
| organosilicon compound solution 1 | 20.0 parts |
| 44% aqueous titanium lactate solution | 3.64 parts |

(TC-310: Matsumoto Fine Chemical Co., Ltd., Corresponds to 1.60 Parts as Titanium Lactate)

The pH of the resulting mixture was then adjusted to 7.0 using a 1 mol/L aqueous NaOH solution and the temperature of the mixture was brought to 50° C. and holding was subsequently carried out for 1.0 hour while mixing using the propeller impeller.

The pH was subsequently adjusted to 9.5 using a 1 mol/L aqueous NaOH solution and holding was carried out for 2.0 hours while stirring at a temperature of 50° C.

After the temperature had been lowered to 25° C., the pH was adjusted to 1.5 with 1 mol/L hydrochloric acid and stirring was performed for 1.0 hour followed by filtration while washing with deionized water to obtain a toner particle 1 having on its surface fine particles containing the reaction product of phosphoric acid and a titanium-containing compound.

This reaction product of phosphoric acid and a titanium-containing compound is the reaction product of titanium lactate (titanium-containing compound) and the phosphate ion deriving from the sodium phosphate or calcium phosphate present in aqueous medium 1.

Toner Particles 2 to 10, 12, 13, 15 to 20, and 24 Production Example

Toner particles 2 to 10, 12, 13, 15 to 20, and 24 were obtained proceeding as in the Toner Particle 1 Production Example, but changing, as shown in Table 2, the type and amount of the metal source, the type and amount of the organosilicon compound solution, and the reaction temperature.

Toner Particle 11 Production Example

Toner particle 11 was produced proceeding as in the Toner Particle 1 Production Example, but changing the step of adjusting the pH of the mixture to 7.0 to a step of adjusting the pH of the mixture to 9.0.

Toner Particle 14 Production Example

The following samples were weighed into a reactor and mixed using a propeller impeller.

| | |
|---|---|
| toner base particle dispersion 2 | 500.0 parts |
| organosilicon compound solution 1 | 10.0 parts |
| aluminum lactate | 1.60 parts |

The temperature of the obtained mixture was then brought to 50° C., followed by holding for 3.0 hours while mixing using a propeller impeller. After the temperature had been lowered to 25° C., the pH was adjusted to 5.0 with 1 mol/L hydrochloric acid and stirring was performed for 1.0 hour followed by filtration while washing with deionized water to obtain a toner particle 14 having on its surface fine particles containing the reaction product of phosphoric acid and an aluminum-containing compound.

Toner Particle 21 Production Example

The temperature of 500.0 parts of toner base particle dispersion 3 was adjusted to 25° C. while stirring.

A mixture of 5.00 parts of isopropyltriisostearoyltitanate (titanate coupling agent) mixed into 20.0 parts of methanol was subsequently added dropwise at a rate of 5 mL/min and stirring in this state was continued for 2.0 hours.

The temperature was then raised to 60° C. while stirring and stirring was continued for an additional 2.0 hours while maintaining 60° C.

This was followed by cooling to 25° C. and solid-liquid separation by suction filtration. Drying was continued for 12 hours by vacuum drying to obtain a toner particle 21, the surface of which was coated with the titanate coupling agent.

Toner Particle 22 Production Example

While stirring 500.0 parts of toner base particle dispersion 3, the pH was adjusted to 1.5 using 1 mol/L hydrochloric acid and stirring was carried out for 1.0 hour at 25° C.

This was followed by filtration while washing with deionized water to obtain toner base particle A.

The following materials were weighed into a reactor and mixed using a propeller impeller.

| | |
|---|---|
| methanol | 590.0 parts |
| toner base particle A | 100.0 parts |

The following materials were added to this and additional mixing was carried out.

| | |
|---|---|
| tetraethoxysilane | 50.0 parts |
| tetraethoxytitanium | 50.0 parts |
| methyltriethoxysilane | 30.0 parts |
| methanol | 400.0 parts |

This dispersion was then added to a mixture of 10,000.0 parts of methanol and 1,000.0 parts of an aqueous ammonium hydroxide solution having a 28% concentration and stirring was carried out for 48 hours at room temperature. Filtration was subsequently performed while washing with purified water, and washing with methanol was then carried out to obtain toner particle 22.

Toner Particle 23 Production Example

Toner base particle 3 as such was designated as toner particle 23.

Toner 1 Production Example

Toner particle 1 was used as such as toner 1.

TEM observation of this toner demonstrated that fine particles were present on the toner particle surface.

A fine particle layer A having a titanium-containing fine particle B and a silicon-containing fine particle was observed in the EDX mapping image of the constituent elements of the toner particle cross section.

As calculated from the acquired images, the number-average particle diameter D of the titanium-containing fine particle B was 19.3 nm, the average value H of the thickness of the fine particle layer A was 16.2 nm, and the standard deviation S on the thickness of the fine particle layer A was 3.7 nm; fine particles elevated up from the toner particle were not observed.

The results of mapping of the element phosphorus confirmed that phosphorus was present in the vicinity of the titanium and a titanium phosphate compound had been produced.

Measurement of the amount of the silicon compound in the toner particle gave 2.2 mass %.

Toners 2 to 21, 23, and 24 Production Example

Toner particles 2 to 21 were used as such as toners 2 to 21.

Toner particle 22 was used as toner 23, and toner particle 24 was used as toner 24.

The properties of each toner are given in Table 3.

TEM observation of toner 21 showed that the toner particle was coated by a thin film, and the presence of fine particles could not be confirmed.

A thin film layer deriving from titanium was observed in the EDX mapping image of the constituent elements in the toner particle cross section.

As determined from the acquired images, the average value H of the thickness of the thin film layer was 14.7 nm and the standard deviation S on the thickness of the thin film layer was 0.7 nm.

Phosphorus in the vicinity of titanium was not confirmed, and a reaction product between phosphoric acid and a titanium-containing compound had not been produced.

On the other hand, TEM observation of toner 23 demonstrated that fine particles were present on the toner particle surface.

A fine particle layer A deriving from titanium and silicon was observed in the EDX mapping image of the constituent elements of the toner particle cross section.

As calculated from the acquired images, the number-average particle diameter D of the titanium-containing fine particle B was 40.3 nm, the average value H of the thickness of the fine particle layer A was 74.9 nm, and the standard deviation S on the thickness of the fine particle layer A was 32.0 nm; formulas (2) and (3) were not satisfied and numerous fine particles elevated up from the toner particle were observed.

According to the results of element mapping, phosphorus in the vicinity of titanium was not confirmed, and a reaction product between phosphoric acid and a titanium-containing compound had not been produced.

Toner 22 Production Example

The following were mixed with toner particle 21 for 10 minutes at a peripheral velocity of 32 m/s using an FM mixer (Nippon Coke & Engineering Co., Ltd.): 0.8 mass % with reference to toner particle 21 of a hydrophobic titania that had been treated with decylsilane and had a volume-average particle diameter of 15 nm, 1.1 mass % with reference to toner particle 21 of a hydrophobic silica (NY50: Nippon Aerosil Co., Ltd.) having a volume-average particle diameter of 30 nm, and 1.0 mass % with reference to toner particle 21 of a hydrophobic silica (X-24: Shin-Etsu Chemical Co., Ltd.) having a volume-average particle diameter of 100 nm. The coarse particles were then removed using a mesh with an aperture of 45 μm to yield toner 22.

TEM observation of toner 22 demonstrated that the toner particle was coated with a thin film and that the added fine particles were present thereon.

A fine particle layer A deriving from a titanium-containing fine particle B and silicon-containing fine particles was observed in the EDX mapping image of the constituent elements of the toner particle cross section.

As calculated from the acquired images, the number-average particle diameter D of the titanium-containing fine particle B was 15.3 nm, the average value H of the thickness of the fine particle layer A was 25.7 nm, and the standard deviation S on the thickness of the fine particle layer A was 10.6 nm. As a consequence, formulas (2) and (3) were not satisfied, and numerous independently occurring fine particles and fine particles elevated up from the toner particle were observed.

According to the results of element mapping, phosphorus in the vicinity of titanium was not confirmed, and a reaction product between phosphoric acid and a titanium-containing compound had not been produced.

Toner 25 Production Example

The following were mixed with toner particle 23 for 10 minutes at a peripheral velocity of 32 m/s using an FM mixer (Nippon Coke & Engineering Co., Ltd.): 1.6 mass % with reference to toner particle 23 of a hydrophobic titania that had been treated with decylsilane and had a volume-average particle diameter of 15 nm, 2.2 mass % with reference to toner particle 23 of a hydrophobic silica (NY50: Nippon Aerosil Co., Ltd.) having a volume-average particle diameter of 30 nm, and 2.0 mass % with reference to toner particle 23 of a hydrophobic silica (X-24: Shin-Etsu Chemical Co., Ltd.) having a volume-average particle diameter of 100 nm. The coarse particles were then removed using a mesh with an aperture of 45 μm to yield toner 25.

TEM observation of toner 25 demonstrated that fine particles were present on the toner particle surface.

A fine particle layer A deriving from a titanium-containing fine particle B and silicon-containing fine particles was observed in the EDX mapping image of the constituent elements of the toner particle cross section.

As calculated from the acquired images, the number-average particle diameter D of the titanium-containing fine particle B was 15.3 nm, the average value H of the thickness of the fine particle layer A was 53.5 nm, and the standard deviation S on the thickness of the fine particle layer A was 17.7 nm. However, formulas (2) and (3) were not satisfied, and numerous independently occurring fine particles and fine particles elevated up from the toner particle were observed.

According to the results of element mapping, phosphorus in the vicinity of titanium was not confirmed, and a reaction product between phosphoric acid and a titanium-containing compound had not been produced.

TABLE 2

| Toner | | Metal source | | Organosilicon compound | | | |
|---|---|---|---|---|---|---|---|
| Toner particle No. | base particle dispersion No. | Type | amount of addition (parts) | No. | Type | amount of addition (parts) | Reaction temperature (° C.) |
| 1 | 1 | Titanium lactate | 1.60 | 1 | MTES | 4.0 | 50 |
| 2 | 1 | Titanium lactate | 0.03 | 1 | MTES | 2.5 | 85 |
| 3 | 1 | Titanium lactate | 0.07 | 1 | MTES | 2.7 | 80 |
| 4 | 1 | Titanium lactate | 0.32 | 1 | MTES | 3.0 | 70 |
| 5 | 1 | Titanium lactate | 3.20 | 2 | VTES | 4.0 | 40 |
| 6 | 1 | Titanium lactate | 4.00 | 2 | VTES | 5.0 | 30 |
| 7 | 1 | Titanium lactate | 6.40 | 2 | VTES | 6.0 | 20 |
| 8 | 1 | Zirconium lactate | 1.60 | 3 | PTMS | 3.5 | 50 |
| 9 | 1 | Zirconium lactate | 1.60 | 3 | PTMS | 1.5 | 50 |
| 10 | 1 | Zirconium lactate | 1.60 | 3 | PTMS | 1.0 | 50 |
| 11 | 1 | Titanium lactate | 1.60 | 1 | MTES | 4.0 | 50 |

TABLE 2-continued

| Toner | | Metal source | | Organosilicon compound | | | |
|---|---|---|---|---|---|---|---|
| Toner particle No. | base particle dispersion No. | Type | amount of addition (parts) | No. | Type | amount of addition (parts) | Reaction temperature (° C.) |
| 12 | 1 | Titanium lactate | 1.60 | 4 | PhTMS | 2.5 | 50 |
| 13 | 1 | Titanium lactate | 1.60 | 5 | DMDES | 2.5 | 50 |
| 14 | 2 | Aluminum lactate | 1.60 | 1 | MTES | 4.0 | 50 |
| 15 | 1 | Copper lactate | 1.60 | 1 | MTES | 4.0 | 50 |
| 16 | 1 | Titanium lactate | 8.00 | 6 | TMES | 2.0 | 85 |
| 17 | 1 | Titanium lactate | 1.60 | 7 | TEOS | 5.0 | 50 |
| 18 | 3 | Titanium lactate | 1.60 | 1 | MTES | 4.0 | 50 |
| 19 | 1 | Titanium lactate | 8.00 | — | — | — | 85 |
| 20 | 3 | None | — | 7 | TEOS | 5.0 | 50 |
| 21 | 3 | Isopropyltriiso stearoyltitanate | 5.00 | — | — | — | — |
| 22 | 3 | Tetraethoxytitanium | 50.0 | — | MTES + TEOS introduced without hydrolysis | 30.0 + 50.0 | — |
| 23 | 3 | None | — | — | — | — | — |
| 24 | 1 | Titanium lactate | 0.50 | 2 | VTES | 7.0 | 10 |

The abbreviations in Table 1 are used for the organosilicon compound names in Table 2. In addition, the amounts for the metal source and the organosilicon compound indicate the amount of introduction of the material itself.

TABLE 3

| Toner | | | | | | Organosilicon compound | | | |
|---|---|---|---|---|---|---|---|---|---|
| Toner No. | particle No. | D (nm) | H (nm) | S (nm) | Electronegativity | Type | amount (mass %) | Polyester incorporation | Metal phosphate |
| 1 | 1 | 19.3 | 16.2 | 3.7 | 1.54 | MTES | 2.2 | Presence | Confirmed |
| 2 | 2 | 5.2 | 4.6 | 1.3 | 1.54 | MTES | 0.7 | Presence | Confirmed |
| 3 | 3 | 7.8 | 6.9 | 2.0 | 1.54 | MTES | 0.9 | Presence | Confirmed |
| 4 | 4 | 10.5 | 8.6 | 2.5 | 1.54 | MTES | 1.2 | Presence | Confirmed |
| 5 | 5 | 27.8 | 24.7 | 5.6 | 1.54 | VTES | 3.2 | Presence | Confirmed |
| 6 | 6 | 40.3 | 32.1 | 7.8 | 1.54 | VTES | 4.2 | Presence | Confirmed |
| 7 | 7 | 85.6 | 45.2 | 25.7 | 1.54 | VTES | 5.2 | Presence | Confirmed |
| 8 | 8 | 19.1 | 28.5 | 5.8 | 1.33 | PTMS | 3.2 | Presence | Confirmed |
| 9 | 9 | 20.2 | 11.0 | 4.2 | 1.33 | PTMS | 1.3 | Presence | Confirmed |
| 10 | 10 | 19.3 | 8.8 | 3.6 | 1.33 | PTMS | 0.8 | Presence | Confirmed |
| 11 | 11 | 20.3 | 16.2 | 9.2 | 1.54 | MTES | 2.2 | Presence | Confirmed |
| 12 | 12 | 19.6 | 17.8 | 2.4 | 1.54 | PhTMS | 2.2 | Presence | Confirmed |
| 13 | 13 | 19.0 | 18.5 | 1.5 | 1.54 | DMDES | 2.2 | Presence | Confirmed |
| 14 | 14 | 19.5 | 16.1 | 3.8 | 1.61 | MTES | 2.2 | Presence | Confirmed |
| 15 | 15 | 19.1 | 16.0 | 4.0 | 1.90 | MTES | 2.2 | Presence | Confirmed |
| 16 | 16 | 18.9 | 4.5 | 2.2 | 1.54 | TMES | 0.2 | Presence | Confirmed |
| 17 | 17 | 19.5 | 15.7 | 6.8 | 1.54 | TEOS | 2.0 | Presence | Confirmed |
| 18 | 18 | 19.8 | 16.5 | 3.8 | 1.54 | MTES | 2.2 | Absence | Confirmed |
| 19 | 19 | 18.8 | 16.8 | 9.4 | 1.54 | None | 0.0 | Presence | Confirmed |
| 20 | 20 | — | 15.4 | 3.8 | — | TEOS | 2.0 | Absence | Not confirmed |
| 21 | 21 | — | 14.7 | 0.7 | 1.54 | None | 0.0 | Absence | Not confirmed |
| 22 | 21 | 15.3 | 25.7 | 10.6 | 1.54 | None | 0.0 | Absence | Not confirmed |
| 23 | 22 | 40.3 | 74.9 | 32.0 | 1.54 | MTES + TEOS | 5.5 | Absence | Not confirmed |
| 24 | 24 | 118.5 | 82.3 | 48.7 | 1.54 | VTES | 6.2 | Presence | Confirmed |
| 25 | 23 | 15.3 | 53.5 | 17.7 | 1.54 | None | 0.0 | Absence | Not confirmed |

The abbreviations in Table 1 are used for the organosilicon compound names in Table 3.

A "Presence" is used in the polyester incorporation column when polyester was incorporated in the toner base particle used. A "Absence" is used in the polyester incorporation column when polyester was not incorporated in the toner base particle used.

A "Confirmed" is used in the metal phosphate column when, in element mapping, the signal originating with the metal was confirmed at the same location at the signal originating with phosphorus. A "Not confirmed" is used in the metal phosphate column when, in element mapping, the signal originating with the metal was not confirmed at the same location at the signal originating with phosphorus.

Examples 1 to 19 and Comparative Examples 1 to 6

The following evaluations were performed using toners 1 to 25. The results of the evaluations are given in Table 4.

The evaluation methods and the evaluation criteria are provided below.

A modified "LBP-712Ci" (Canon, Inc.) commercial laser printer was used for the image-forming device; this was modified to give a process speed of 250 mm/sec. A 040H toner cartridge (cyan, Canon, Inc.), which is a commercial process cartridge, was used.

The onboard toner was removed from the cartridge; cleaning was performed with an air blower; and filling was carried out with 165 g of a toner as described above. The onboard toner was removed at each of the yellow, magenta, and black stations, and the evaluations were performed with the yellow, magenta, and black cartridges installed, but with the residual toner detection mechanisms inactivated.

(1) Evaluation of Charge Rise Performance

The aforementioned process cartridge and modified laser printer and the evaluation paper (GF-0081 (Canon, Inc.), A4, 81.4 g/m$^2$) were held for 48 hours in a normal-temperature, normal-humidity environment (25° C./50% RH, referred to in the following as the N/N environment).

An image was output on the evaluation paper while operating in the N/N environment. Considered along the length of the paper, the image had a completely black image area (laid-on level=0.45 mg/cm$^2$) in the shape of a transverse band with a length of 10 mm, placed in the position from 10 mm to 20 mm from the front edge of the paper; then, downstream therefrom, a completely white image area (laid-on level=0.00 mg/cm$^2$) with a length of 10 mm; then downstream therefrom, a halftone image area (laid-on level=0.20 mg/cm$^2$) with a length of 100 mm.

The charge rise performance was evaluated using the criteria given below and using the difference, in the halftone image area, between the image density in the region corresponding to one revolution of the developing roller downstream from the completely black image area and the image density corresponding to one revolution of the developing roller downstream from the completely white image area.

The measurement of the image density was carried out using a "MacBeth RD918 Reflection Densitometer" (MacBeth Corporation) in accordance with the instruction manual provided with the instrument. The measurement was performed by measuring the relative density versus a white background area image having an image density of 0.00; the obtained relative density was used as the image density value.

The charge rise performance was evaluated using the evaluation criteria given below.

When the charge rise performance is excellent, the toner supplied onto the developing roller is rapidly charged and as a consequence there is no variation between the image density after the completely black area and the image density after the completely white area and an excellent image is obtained.

Evaluation Criteria for Charge Rise Performance

A: the image density difference is less than 0.03

B: the image density difference is at least 0.03, but less than 0.06

C: the image density difference is at least 0.06, but less than 0.10

D: the image density difference is at least 0.10

(2) Evaluation of Durability

After the evaluation of the charge rise performance, and while operating in the N/N environment, 25,000 prints were continuously output on the evaluation paper of an image having a print percentage of 0.5%. After standing in the same environment for 24 hours, an evaluation was performed proceeding as in the evaluation of the charge rise performance.

The durability was evaluated using the evaluation criteria given above for the charge rise performance. In addition, the developing roller was visually inspected and scored for the presence/absence of contamination by the metal compound fine particles.

(3) Evaluation of Environmental Stability

The aforementioned process cartridge and modified laser printer and the evaluation paper (HP Brochure Paper, 180 g, Glossy (HP), letter, 180 g/m$^2$) were held for 48 hours in a high-temperature, high-humidity environment (30° C./80% RH, referred to in the following as the H/H environment).

Then, with the process speed changed to 83 mm/sec (⅓-speed), a completely white image with a print percentage of 0% was output on the evaluation paper in the H/H environment.

The fogging density on the completely white image was measured and the charging performance was evaluated using the criteria given below.

The measurement of the fogging density (%) was carried out using a "Reflectometer Model TC-6DS" (Tokyo Denshoku Co., Ltd.), and the fogging density (%) was calculated as the difference between the whiteness measured on the white background area of the image and the whiteness of the transfer paper. An amber filter was used for the filter.

An excellent image exhibiting little fogging can be obtained using a toner that has an excellent charging performance.

An excellent charging performance will be exhibited, even in a high-humidity environment, by a toner having an excellent environmental stability and a low surface layer hygroscopicity. Moreover, a low-fogging toner can raise the toner cartridge yield by keeping the toner consumption down during long-term use.

Criteria for Evaluating Environmental Stability

A: the fogging density is less than 0.5%

B: the fogging density is at least 0.5%, but less than 1.0%

C: the fogging density is at least 1.0%, but less than 2.0%

D: the fogging density is at least 2.0%

(4) Evaluation of Charge Quantity Distribution

The aforementioned process cartridge and modified laser printer and the evaluation paper (GF-0081 (Canon, Inc.), A4, 81.4 g/m$^2$) were held for 48 hours in a low-temperature, low-humidity environment (15° C./10% RH, referred to in the following as the L/L environment).

While operating in the L/L environment, a completely black image was output on the evaluation paper; the machine was stopped during transfer from the photosensitive member to the intermediate transfer member; and the toner laid-on level M1 (mg/cm$^2$) on the photosensitive member prior to the transfer step and the toner laid-on level M2 (mg/cm$^2$) on the photosensitive member after the transfer step were measured. Using the obtained toner laid-on levels, the transfer efficiency (%) was calculated as $(M1-M2)\times 100/M1$.

A toner with a sharp charge quantity distribution readily tracks the potential in the transfer step and thus exhibits a high transfer efficiency. In addition, a toner with a high transfer efficiency, by keeping down the amount of toner consumption during long-term use, can increase the toner cartridge yield.

Criteria for Evaluating Toner Charge Distribution

A: the transfer efficiency is at least 95%

B: the transfer efficiency is at least 90%, but less than 95%

C: the transfer efficiency is at least 85%, but less than 90%

D: the transfer efficiency is less than 85%

TABLE 4

| | | Charge rise performance | | Durability | | | Environmental stability | | Charge quantity distribution | |
|---|---|---|---|---|---|---|---|---|---|---|
| | Toner No. | Numerical value | Evaluation | Numerical value | Evaluation | Presence/Absence of contamination | Numerical value | Evaluation | Numerical value | Evaluation |
| Example 1 | 1 | 0.01 | A | 0.01 | A | Absence | 0.3 | A | 96 | A |
| Example 2 | 2 | 0.01 | A | 0.01 | A | Absence | 0.2 | A | 95 | A |
| Example 3 | 3 | 0.01 | A | 0.01 | A | Absence | 0.3 | A | 96 | A |
| Example 4 | 4 | 0.01 | A | 0.01 | A | Absence | 0.3 | A | 96 | A |
| Example 5 | 5 | 0.01 | A | 0.01 | A | Absence | 0.3 | A | 97 | A |
| Example 6 | 6 | 0.01 | A | 0.03 | B | Absence | 0.3 | A | 98 | A |
| Example 7 | 7 | 0.02 | A | 0.04 | B | Absence | 0.4 | A | 99 | A |
| Example 8 | 8 | 0.01 | A | 0.01 | A | Absence | 0.4 | A | 96 | A |
| Example 9 | 9 | 0.01 | A | 0.01 | A | Absence | 0.4 | A | 96 | A |
| Example 10 | 10 | 0.01 | A | 0.03 | B | Absence | 0.4 | A | 96 | A |
| Example 11 | 11 | 0.01 | A | 0.02 | A | Absence | 0.3 | A | 96 | A |
| Example 12 | 12 | 0.01 | A | 0.02 | A | Absence | 0.3 | A | 96 | A |
| Example 13 | 13 | 0.03 | B | 0.05 | B | Absence | 0.2 | A | 95 | A |
| Example 14 | 14 | 0.01 | A | 0.01 | A | Absence | 0.3 | A | 96 | A |
| Example 15 | 15 | 0.03 | B | 0.05 | B | Absence | 0.2 | A | 96 | A |
| Example 16 | 16 | 0.01 | A | 0.07 | C | Absence | 0.3 | A | 97 | A |
| Example 17 | 17 | 0.01 | A | 0.02 | A | Absence | 1.5 | C | 95 | A |
| Example 18 | 18 | 0.01 | A | 0.03 | B | Absence | 0.3 | A | 88 | C |
| Example 19 | 19 | 0.01 | A | 0.09 | C | Absence | 1.2 | C | 95 | A |
| Comparative Example 1 | 20 | 0.15 | D | 0.16 | D | Absence | 1.5 | C | 88 | C |
| Comparative Example 2 | 21 | 0.32 | D | 0.33 | D | Absence | 2.2 | D | 86 | C |
| Comparative Example 3 | 22 | 0.02 | A | 0.35 | D | Presence | 1.5 | C | 89 | C |
| Comparative Example 4 | 23 | 0.02 | A | 0.12 | D | Presence | 0.8 | B | 88 | C |
| Comparative Example 5 | 24 | 0.02 | A | 0.11 | D | Presence | 0.4 | A | 99 | A |
| Comparative Example 6 | 25 | 0.02 | A | 0.37 | D | Presence | 1.2 | C | 88 | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-011287, filed Jan. 26, 2018, which is hereby incorporated by reference herein in its entirety.

What is claimed is:

1. A toner comprising a toner particle comprising:

a toner base particle comprising a binder resin; and a plurality of fine particles on a surface of the toner base particle, wherein a fine particle layer A is constituted of the plurality of fine particles observed in an EDX mapping image of a constituent elements in a cross section of the toner particle as provided by energy dispersive x-ray spectroscopy of the toner particle cross section observed using a transmission electron microscope, a fine particle B comprising a metal compound observed in the fine particle layer A, said metal compound comprising at least one metal element M selected from the group consisting of metal elements belonging to Groups 3 to 13, and $$1.0 \leq D \leq 100.0,$$

$$0.10 \times D \leq H \leq 1.50 \times D, \text{ and}$$

$$S \leq 0.50 \times D$$

where D (nm) is the number-average particle diameter of the fine particle B, H (nm) is the average value of the thickness of the fine particle layer A, and S (nm) is the standard deviation of the thickness of the fine particle layer A.

2. The toner according to claim 1, wherein D is 1.0 to 30.0 nm.

3. The toner according to claim 1, wherein $$0.50 \times DH1.50 \times D, \text{ and}$$

$$0.10 \times D \leq S \leq 0.50 \times D.$$

4. The toner according to claim 1, wherein the Pauling electronegativity of the metal element is 1.25 to 1.85.

5. The toner according to claim 1, wherein fine particle B further comprises a condensate of an organosilicon compound.

6. The toner according to claim 5, wherein the condensate of an organosilicon compound is a condensate of at least one organosilicon compound represented by $$Ra_{(n)}\text{—Si—}Rb_{(4-n)}$$

where Ra independently represents a halogen atom or an alkoxy group; Rb independently represents an alkyl group, alkenyl group, acyl group, aryl group or methacryloxyalkyl group; and n is an integer of 2 or 3.

7. The toner according to claim 1, wherein the toner particle comprises a polyester resin.

* * * * *